US009725991B2

(12) United States Patent
Novelen

(10) Patent No.: US 9,725,991 B2
(45) Date of Patent: Aug. 8, 2017

(54) SCREENED COMMUNICATION CONNECTOR FOR A PRODUCTION TUBING JOINT

(71) Applicant: Halliburton Energy Services, Inc., Houston, TX (US)

(72) Inventor: Ryan Michael Novelen, Grand Prairie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/912,575

(22) PCT Filed: Sep. 16, 2014

(86) PCT No.: PCT/US2014/055895

§ 371 (c)(1),
(2) Date: Feb. 17, 2016

(87) PCT Pub. No.: WO2016/043721

PCT Pub. Date: Mar. 24, 2016

(65) Prior Publication Data

US 2016/0290110 A1 Oct. 6, 2016

(51) Int. Cl.
*E21B 43/08* (2006.01)
*E21B 17/02* (2006.01)
(Continued)

(52) U.S. Cl.
CPC ..... *E21B 43/084* (2013.01); *E21B 17/04* (2013.01); *E21B 17/046* (2013.01);
(Continued)

(58) Field of Classification Search
CPC ..... E21B 43/088; E21B 43/08; E21B 43/084; E21B 43/086; E21B 43/12; E21B 43/14; E21B 17/02
See application file for complete search history.

(56) References Cited

U.S. PATENT DOCUMENTS 2,353,881 A * 7/1944 Crake ..... E21B 43/088 166/158
4,368,785 A * 1/1983 Gondek ..... E21B 4/06 175/21

(Continued)

FOREIGN PATENT DOCUMENTS

EP 0783074 7/1997

OTHER PUBLICATIONS

International Search Report and Written Opinion, Application No. PCT/US2014/055895; 12 pages, Jun. 10, 2015.

*Primary Examiner* — Kipp Wallace
(74) *Attorney, Agent, or Firm* — Baker Botts L.L.P.

(57) ABSTRACT

In accordance with some embodiments of the present disclosure, a screened communication connector for a production tubing joint is disclosed. The screened communication connector including a hollow body including a plurality of holes to block particulate material from passing therethrough and allow fluid to pass therethrough. The screened communication connector additionally includes a first axial end of the hollow body including a first seal member for creating a particle tight seal between the first axial end and a first screen joint. The screened communication connector additionally includes a second axial end of the hollow body, the second axial end including a second seal member for creating a particle tight seal between the second axial end and a second screen joint.

20 Claims, 5 Drawing Sheets

(51) Int. Cl.

| | |
|---|---|
| ***E21B 17/046*** | (2006.01) |
| ***E21B 17/10*** | (2006.01) |
| ***E21B 17/04*** | (2006.01) |
| *E21B 43/14* | (2006.01) |

(52) U.S. Cl.
CPC ..... *E21B 17/105* (2013.01); *E21B 43/086* (2013.01); *E21B 43/088* (2013.01); *E21B 43/14* (2013.01)

(56) References Cited

U.S. PATENT DOCUMENTS 4,378,840 A * 4/1983 Lilly ..... B01D 29/111 166/233
4,510,996 A 4/1985 Hardin
5,156,220 A 10/1992 Forehand et al.
5,553,979 A * 9/1996 Wittig ..... E02D 9/02 166/93.1
5,722,463 A 3/1998 Smyth et al.
5,787,980 A * 8/1998 Sparlin ..... E21B 43/088 166/231
5,803,179 A 9/1998 Echols et al.
5,868,200 A * 2/1999 Bryant ..... E21B 43/08 166/242.3
5,881,812 A * 3/1999 Malbrel ..... B01D 29/111 166/278
5,896,928 A 4/1999 Coon
6,062,307 A * 5/2000 Hamid ..... E21B 43/08 166/233
6,405,800 B1 6/2002 Walker et al.
6,446,729 B1 9/2002 Bixenman et al.
6,776,241 B2 * 8/2004 Castano-Mears ..... E21B 43/084 166/227
6,978,840 B2 * 12/2005 Henderson ..... E21B 34/14 166/296
6,983,795 B2 1/2006 Zuklic et al.
7,048,061 B2 5/2006 Bode et al.
7,191,833 B2 * 3/2007 Richards ..... E21B 34/063 166/115
7,407,197 B2 8/2008 Gronquist
7,520,535 B2 4/2009 Gronquist
7,735,559 B2 6/2010 Malone
8,225,863 B2 7/2012 Hammer et al.
8,245,789 B2 8/2012 Holderman et al.
8,511,380 B2 8/2013 Guignard et al.
2009/0008084 A1 1/2009 Dybevik et al.
2011/0114332 A1 * 5/2011 Elrick ..... E21B 17/18 166/369
2012/0048536 A1 3/2012 Holderman et al.
2014/0000913 A1 1/2014 Greci et al.
2014/0110132 A1 4/2014 Cunningham

* cited by examiner

SCREENED COMMUNICATION CONNECTOR FOR A PRODUCTION TUBING JOINT

RELATED APPLICATION

This application is a U.S. National Stage Application of International Application No. PCT/US2014/055895 filed Sep. 16, 2014, which designates the United States, and which is incorporated herein by reference in its entirety.

TECHNICAL FIELD

The present disclosure relates generally to well drilling and hydrocarbon recovery operations and, more particularly, to screens in a wellbore.

BACKGROUND

During recovery operations in wells, different stimulation techniques may be performed downhole, including nitrogen circulation, acidizing, fracturing, or a combination of acidizing and fracturing. Acidizing and nitrogen circulation are designed to clean up residues and skin damage in the wellbore in order to improve the flow of hydrocarbons. Fracturing is designed to create fractures in the formation surrounding the wellbore to allow hydrocarbons to flow from a reservoir into the well. To enable the use of these stimulation techniques, perforations, or holes, may be created in a downhole casing in the wellbore. The perforations allow acid and other fluids to flow from the wellbore into the surrounding formation. The perforations may also allow hydrocarbons to flow into the wellbore from fractures in the formation created during fracturing techniques.

Recovery operations may also include using one or more sections of screened production tubing joints. The screened production tubing joints may be placed in the wellbore opposite the fractures or perforations and may allow fluids to flow into the wellbore while blocking sand, rock, or other sediments from entering the wellbore.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

A screened communication connector for production tubing joints is disclosed. During subterranean operations, production tubing may be run along a wellbore to facilitate transporting fluids, such as oil or water, from the wellbore to the surface. The walls of the wellbore may be perforated or the rock formation surrounding the wellbore may be fractured to facilitate the flow of fluids (e.g., gas and/or liquid) into the wellbore. When the well is producing fluids, sand or other particulate material created during the perforation or fracturing process may be carried to the wellbore by the flow of fluid into the wellbore. If allowed to flow through the wellbore, the sand or particulate material may damage components of the subterranean operation. In order to prevent damage, one or more portions of the production tubing may include a screen joint where the walls are formed of a mesh screen, wire-wrap screen, premium screen, or slotted liner, or any other suitable screen material. The screen or liner may allow fluid to flow into the production tubing while blocking sand and particulate material from entering the tubing. The screen joints may be connected to each other or to other portions of the production tubing by a communication connector. The communication connector may be a piece of production tubing designed to slide or clamp over the coupling of two screen joints or the coupling of a screen joint and a piece of production tubing. In some embodiments, the communication connector may also be formed of mesh screen, wire-wrap screen, premium screen, or slotted liner material, similar to the screen joints. A screened communication connector may maximize the screen coverage in the production tubing and provide uninterrupted screen coverage in a production zone of the wellbore. Accordingly, a screened communication connector may be formed in accordance with the teachings of the present disclosure and may have different designs, configurations, and/or parameters according to a particular application. Embodiments of the present disclosure and its advantages are best understood by referring to FIGS. 1 through 5, where like numbers are used to indicate like and corresponding parts.

Figure 1:
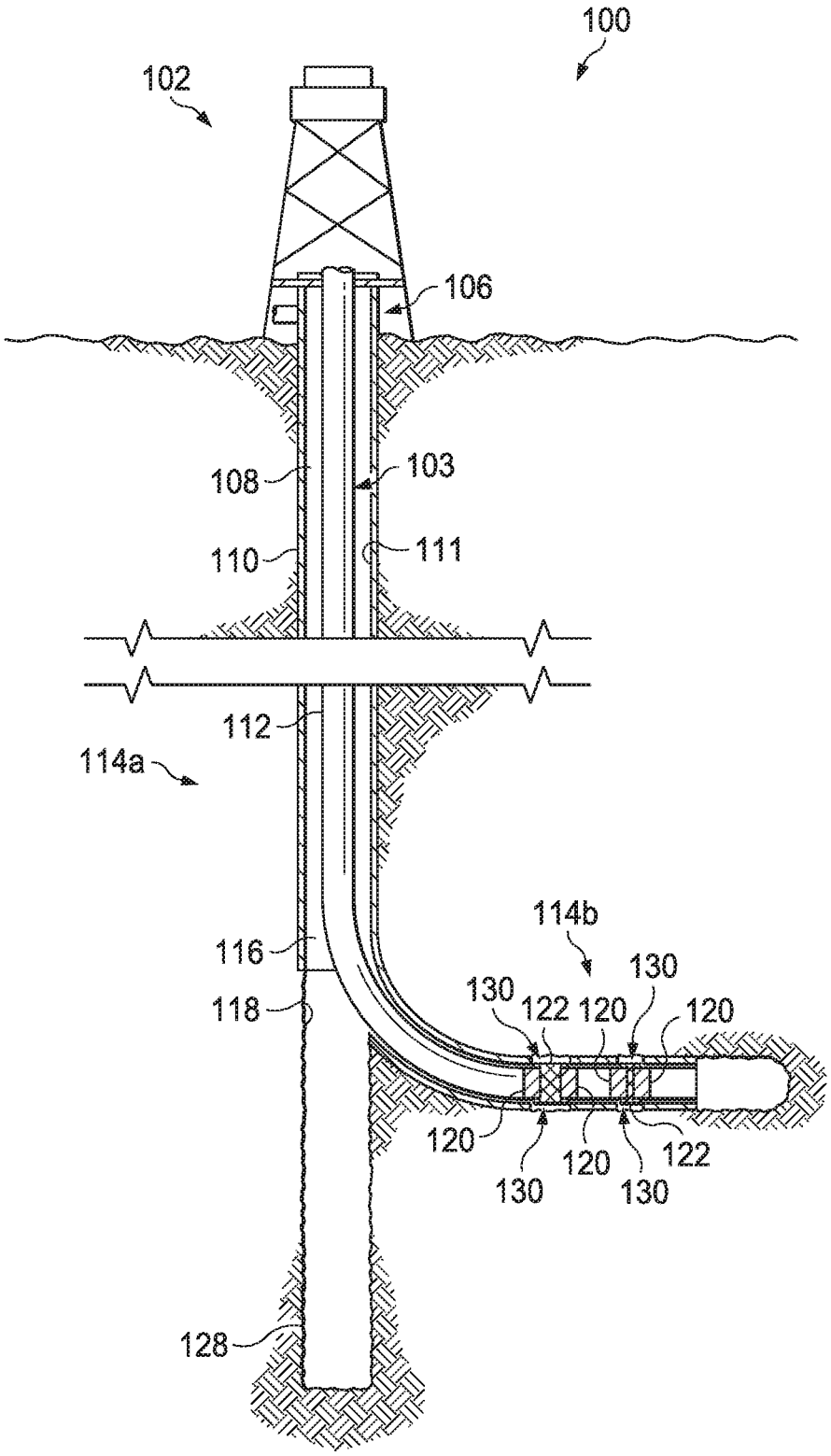
FIG. 1 illustrates an elevation view of an example embodiment of a subterranean operations system, in accordance with some embodiments of the present disclosure.

FIG. 1 illustrates an elevation view of an example embodiment of a subterranean operations system, in accordance with some embodiments of the present disclosure. In the illustrated embodiment, subterranean operations system 100 may be associated with land-based subterranean operations. However, subterranean operations tools incorporating teachings of the present disclosure may be satisfactorily used with subterranean operations equipment located on offshore platforms, drill ships, semi-submersibles, and drilling barges.

Subterranean operations system 100 may include wellbore 114 that is defined in part by casing string 110 that may extend from well surface 106 to a selected downhole location. Portions of wellbore 114 that do not include casing string 110 may be described as "open hole." "Uphole" may be used to refer to a portion of wellbore 114 that is closer to well surface 106 and "downhole" may be used to refer to a portion of wellbore 114 that is further from well surface 106.

Wellbore 114 may be formed vertically, such as generally vertical wellbore 114*a*, or non-vertically, such as generally horizontal 114*b* wellbore, or any combination thereof. Various directional drilling techniques may be used to form horizontal wellbore 114*b*. The term "directional drilling" may be used to describe drilling a wellbore or portions of a wellbore that extend at a desired angle or angles relative to vertical. The desired angles may be greater than normal variations associated with vertical wellbores. Direction drilling may also be described as drilling a wellbore deviated from vertical. The term "horizontal drilling" may be used to include drilling in a direction approximately ninety degrees (90°) from vertical.

Various types of fluid, such as oil, water, or gas, may be pumped from downhole to well surface 106 through wellbore 114. The fluids may be directed to flow through production tubing 103 or through annulus 108. In open hole embodiments, annulus 108 may be defined in part by outside diameter 112 of production tubing 103 and inside diameter 118 of wellbore 114. In embodiments using casing string 110, annulus 108 may be defined by outside diameter 112 of production tubing 103 and inside diameter 111 of casing string 110.

Some portions of production tubing 103 may include one or more screen joints 120. In the illustrated embodiment, screen joints 120 may be aligned with one or more perforations 130 in casing string 110. In some embodiments, screen joints 120 may be aligned with a fracture in a rock formation surrounding wellbore 114. Screen joints 120 may allow fluids to enter production tubing 103 while blocking sand or other particulate material. Screen joints 120 may be formed of a mesh screen material. The gauge of the mesh forming the screen may be designed based on the size of the particles in the wellbore, the strength and durability requirements of the environment in the wellbore, and/or any other suitable design characteristic. Multiple screen joints 120 may be connected with a communication connector which may provide a seal between the communication connector and an end of a screen joint 120 so that sand or particulate material may be prevented from entering production tubing 103 between screen joints 120.

In some subterranean operations, wellbore 114 may span more than one reservoir or more than one areas of the reservoir where an optimal flow of fluids from the reservoir to wellbore 114 may be achieved. An area of the reservoir where the optimal flow of fluids may be achieved may be referred to as a "pay zone" and a subterranean operation in a wellbore spanning multiple pay zones may be referred to as a "multi-zone completion." Wellbore 114 may be fractured or perforated in one or more pay zones to facilitate the production of fluids from the pay zones. In some embodiments, multiple sections of screen joints 120 and screened communication connectors 122 may be installed along production tubing 103 in the pay zones. The areas of production tubing 103 between the pay zones may not include screen joints 120 and/or communication connectors.

Figure 2:
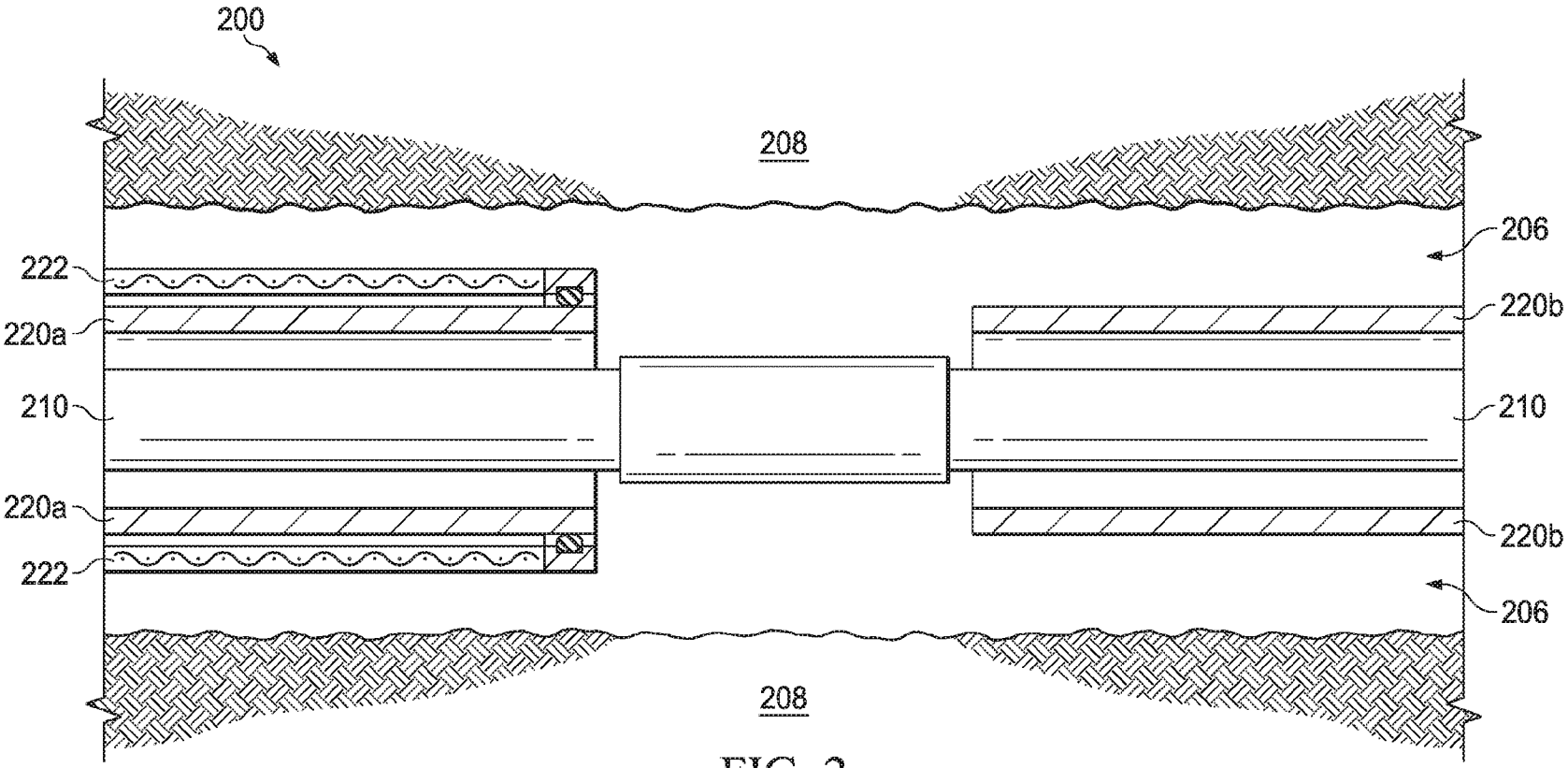
FIG. 2 illustrates a cross-sectional view of a wellbore including screen pipe joints and a screened communication connector in a stowed position, in accordance with some embodiments of the present disclosure.

In some embodiments of the disclosure, it may be advantageous to allow fluid to flow into production tubing 103 in the areas between screen joints 120, as disclosed in further detail with respect to FIG. 2. As such, screen joints 120 may be connected by screened communication connector 122. Screened communication connectors 122 may connect two screen joints 120 and provide a seal between the two screen joints 120 that prevents particles from entering production tubing 103 between screen joints 120. For example, screen communication connector 122 may prevent sand or particulate material from entering production tubing 103 in the area between screen joints 120 and/or the area where a screen joint 120 and screened communication connector 122 are in contact. Screened communication connector 122 may be formed of a mesh screen, similar to the mesh screen that forms screen joints 120. Screened communication connector 122 may be removable and/or able to be repositioned along production tubing 103. Therefore, a screened communication connector designed according to the present disclosure may maximize the screen coverage and provide an uninterrupted screen area in an area of wellbore 114.

FIG. 2 illustrates a cross-sectional view of a wellbore including screen joints and a screened communication connector in a stowed position, in accordance with some embodiments of the present disclosure. During installation of screen joints 220*a* and 220*b* ("screen joints 220") and base pipe 210 into wellbore 200, screened communication connector 222 may be stowed over the top of a section of screen joint 220 (e.g., over screen joint 220*a* or over screen joint 220*b*). In FIG. 2, screened communication connector 222 is shown stowed over screen joint 220*a*, although it may be stowed over screen joint 220*b*. After screen joints 220 are installed into wellbore 200, screened communication connector 222 may be placed over the open space between screen joint 220*a* and screen joint 220*b*, as described in more detail in FIG. 3.

Screen joints 220 and screened communication connector 222 may be formed of a mesh screen. The mesh screen may be a tube of a screen material. The screen may be formed of wire-wrap screen, premium screen, or any other suitable screen material. The wire-wrap screen may include corrosion-resistant wire wrapped around base pipe 210. The premium screen may include a woven metal cloth wrapped around base pipe 210. In some embodiments, screen joints 220 and/or screened communication connector 222 may be formed of a slotted liner. A slotted liner may be a tube with fixed size channels machined in the sides of the tube. The channels may be machined in a longitudinal direction along the length of screen joints 220 and/or screened communication connector 222 or may be machined in a latitudinal direction around the circumference of screen joints 220 and/or screened communication connector 222. Mesh screen and slotted liner may perform the same function of preventing sand or particulate material from wellbore 200 from entering base pipe 210.

Annular space 206 may be sized based on the requirements of the subterranean operation. For example, annular space 206 may be sized to allow fluid to flow from reservoir 208, through screen joints 220 and/or screened communication connector 222, and into base pipe 210. In embodiments where annular space 206 maybe limited, screen joints 220 and/or screened communication connector 222 may be made of slotted liner. Due to the slotted liner being machined, screen joint 220 or screened communication connector 222 formed of slotted liner may be thinner than a screen joint 220 or screened communication connector 222 formed of mesh screen. The mesh screen may be thicker due to the number of layers of wire that are wrapped around the base pipe to provide a mesh with a small gauge that blocks particulate materials with a small diameter. Screen joints 220 and/or screened communication connector 222 formed of a slotted liner may be less expensive than screen joints 220 and/or screened communication connector 222 formed of a mesh screen due to the ease of manufacturing slotted liner.

In some embodiments, the gauge of the mesh screen or the size of the slots in the slotted liner used to form screen joints 220 and/or screened communication connector 222 may be the same size across screen joints 220 and screened communication connector 222. In other embodiments, the gauge of the mesh screen or the size of the slots in the slotted liner used to form screen joints 220 may be different from the gauge of the mesh screen or the size of the slots in the slotted liner used to form screened communication connector 222. The mesh gauge of the screen material and/or the size of the slots in the slotted liner may be designed based on the size of the particles in the wellbore, the strength and durability requirements of the environment in the wellbore, and/or any other suitable design characteristic.

Figure 3:
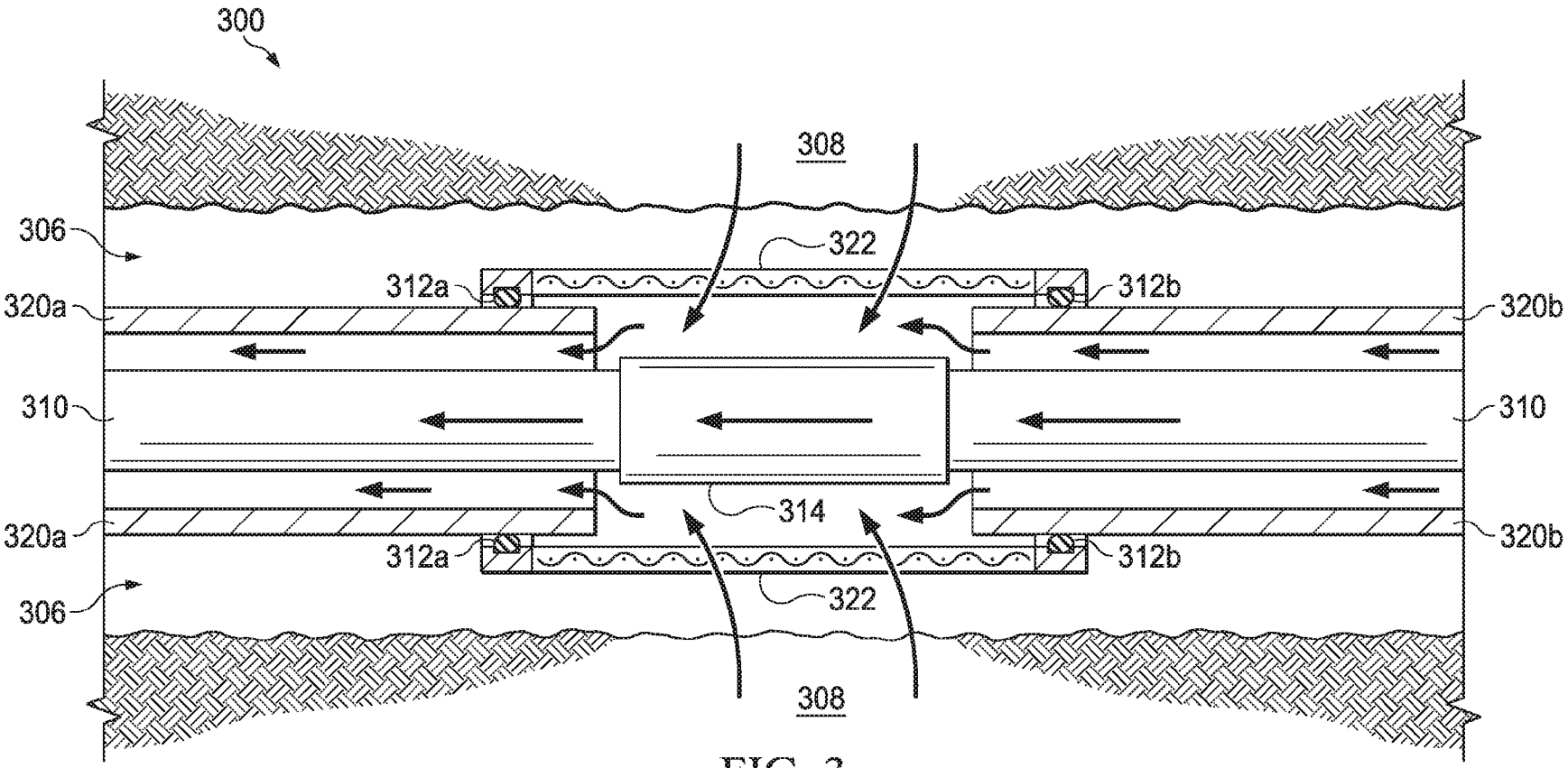
FIG. 3 illustrates a cross-sectional view of a wellbore including screen pipe joints and a screened communication connector in an installed position, in accordance with some embodiments of the present disclosure.

Screened communication connector 222 may be designed to move from a stowed position to an installed position. FIG. 3 illustrates a cross-sectional view of a wellbore including screen joints and a screened communication connector in an installed position, in accordance with some embodiments of the present disclosure. In one embodiment, screened communication connector 322 may be moved from a stowed position to an installed position by sliding. However, it will be appreciated that screened communication connector 322 may be moved from a stowed position to an installed position through any suitable means and remain within the scope of the present disclosure. For example, screened communication connector 322 may slide into place and bridge the open space between screen joint 320*a* and screen joint 320*b* and/or span casing coupling 314. After screened communication connector 322 is placed in the installed position, screened communication connector 322 may be designed such that screened communication connector 322 may be returned to a stowed position by sliding or any other suitable method of moving screened communication connector 322 from an installed position to a stowed position. Screened communication connector 322 may be repositioned to a stowed position when the production tubing is removed from wellbore 300 or when the requirements of the subterranean operation involve the need for repositioning screened communication connector 322.

Screen joints 320*a* and 320*b* ("screen joints 320"), screened communication connector 322, and base pipe 310 may be components of a production tubing system such as production tubing 103 shown in FIG. 1, and may be constructed of similar materials as screen joints 220 and screened communication connector 222, shown in FIG. 2. Screened communication connector 322 may bridge the open space between two screen joints 320 and/or span casing coupling 314 between two portions of base pipe 310. Fluid may flow from formation 308 surrounding wellbore 200 into annular space 306. Formation 308 may include one or more reservoirs containing hydrocarbons. Additionally, fluid may flow from formation 308 into base pipe 310 by flowing through screen joints 320 and/or screened communication connector 322.

Screened communication connector 322 may maximize the screen coverage in the production tubing system and provide uninterrupted screen coverage in a production zone of wellbore 300. For example, screened communication connector 322 may be several feet long and may allow fluids to enter base pipe 310 along the length of screened communication connector 322, while a communication connector that does not include a screen may not allow fluid to enter base pipe 310 and may divert the fluid flow to screen joint 320*a* or 320*b*. When fluid is diverted to screen joints 320, a high pressure point may be created on each side of the communication connector due to a high rate of fluid flow in a localized area. A high pressure point may cause damage to screen joints 320. Therefore, screened communication connector 322 may provide equal pressure across screened communication connector 322 and screen joints 320 to provide an even flow rate through screened communication connector 322 and screen joints 320 and into base pipe 310.

Screened communication connector 322 may further include seal members 312*a* and 312*b* ("seal members 312") located at one or both axial ends of screened communication connector 322. When screened communication connector 322 is in an installed position, seal members 312 may provide a seal to prevent sand or particulate material from entering base pipe 310 at seal members 312 where screen joints 320 connect with screened communication connector 322. Seal members 312 may be formed of O-rings, threads, an interference fit, welding, deforming, or any other suitable connection that may provide a seal to prevent sand or particulate material from entering base pipe 310 at seal members 312.

In some embodiments, wellbore 300 may also include gravel (not expressly shown) packed around screen joints 320 and/or screened communication connector 322. The gravel may block larger pieces of particulate material from entering wellbore 300 and the screen joints 320 and/or screened communication connector 322 may block smaller pieces of particulate material from entering base pipe 310. In an alternative embodiment, a slotted liner may be used to form screen joints 320 and/or screened communication connector 322.

Figure 4:
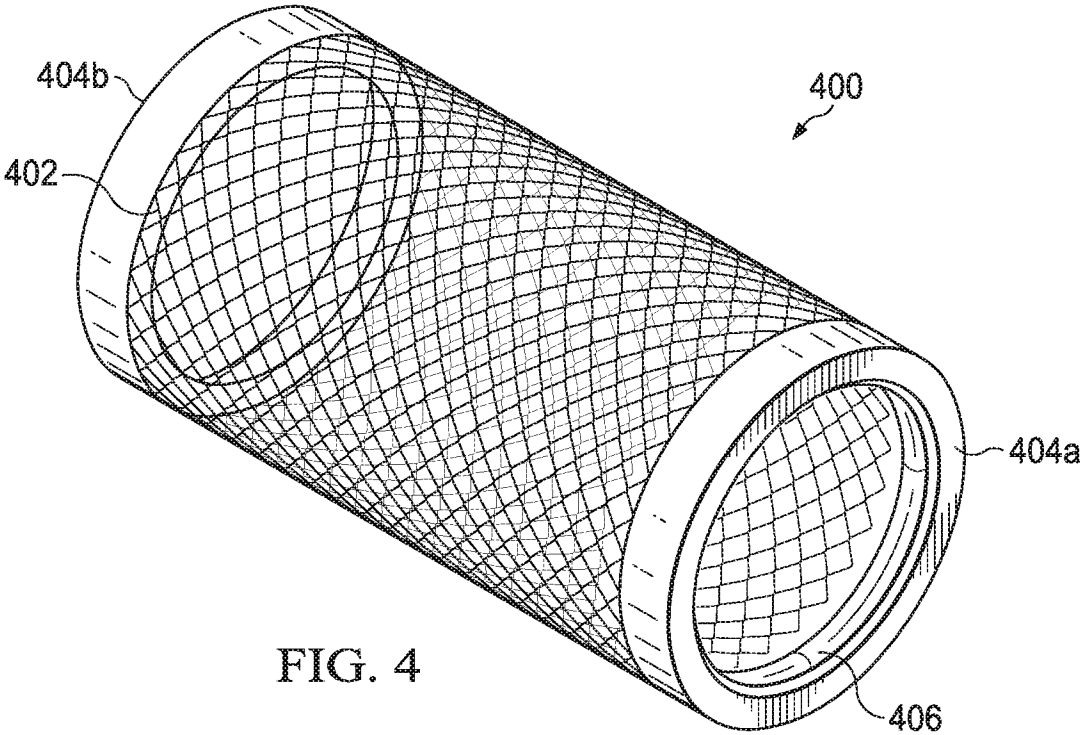
FIG. 4 illustrates a single-piece screened communication connector, in accordance with some embodiments of the present disclosure.

In some embodiments, screened communication connector 322 may be a single-piece tube, as shown in FIG. 4. FIG. 4 illustrates a single-piece screened communication connector, in accordance with some embodiments of the present disclosure. Screened communication connector 400 may be constructed in various dimensions to form a tube. Screened communication connector 400 may have a length at least as long as an open space between two screen joints. For example, the length of screened communication connector 400 may be approximately three to eight feet. Screened communication connector 400 may be constructed from a generally rectangular sheet of material by coupling two opposing edges together to form a cylindrical tube. The material may be any suitable type of material designed to withstand the conditions in a wellbore during subterranean operations, such as stainless steel or a nickel alloy, and may be a material used to form a mesh screen or a slotted liner. In some embodiments, the two opposing edges of screened communication connector 400 may be coupled by welding, brazing, or any other suitable coupling method that may have sufficient strength to withstand the conditions in a wellbore. When the two opposing edges of screened communication connector 400 are coupled together, an interior volume may be formed. In other embodiments, screened communication connector 400 may be a seamless tube, creating an interior volume by drawing a piece of material over a piercing rod. The interior volume may have an inner diameter equal to at least the outer diameter of the screen joints that screened communication connector 400 is designed to connect in order to allow screened communication connector 400 to slide from a stowed position to an installed position.

Ends 404*a* and 404*b* ("ends 404") may be shrouds that hold mesh screen 402 in place without the opposing ends of mesh screen 402 having to be welded or brazed to form the cylindrical shape of screened communication connector 400. Screened communication connector 400 may have one or more O-rings 406 located at or near one or both ends 404*a* and 404*b*. O-ring 406 may be designed to allow screened communication connector 400 to seal an open space between two screen joints while allowing screened communication connector 400 to slide from a stowed position to an installed position. In the installed position, O-ring 406 may serve as a seal member, such as seal member 312*a* or 312*b* shown in FIG. 3. In other embodiments, screened communication connector may have threads (not expressly shown) located on one or both ends 404*a* and 404*b*. The threads may be designed to connect screened communication connector 400 with one or more screen joints and may serve as a seal member. In yet another embodiment, screened communication connector 400 may be designed such that after screened communication connector 400 is in the installed position, screened communication connector 400 forms an interference fit with one or more screen joints. In an interference fit embodiment, the friction between screened communication connector 400 and the screen joint fastens the two components together without the use of any mechanical fasteners. O-ring 406, threads, or an interference fit may be designed such that the area between screened communication connector 400 and one or more screen joints is sealed so sand or other particulate material may not pass through the seal member.

In some embodiments, screened communication connector 400 may be covered from end 404*a* to end 404*b* by mesh screen 402. Mesh screen 402 may be formed of wire-wrap screen, premium screen, or any other suitable screen material. In other embodiments, screened communication connector 400 may be formed of a slotted liner.

Figure 5:
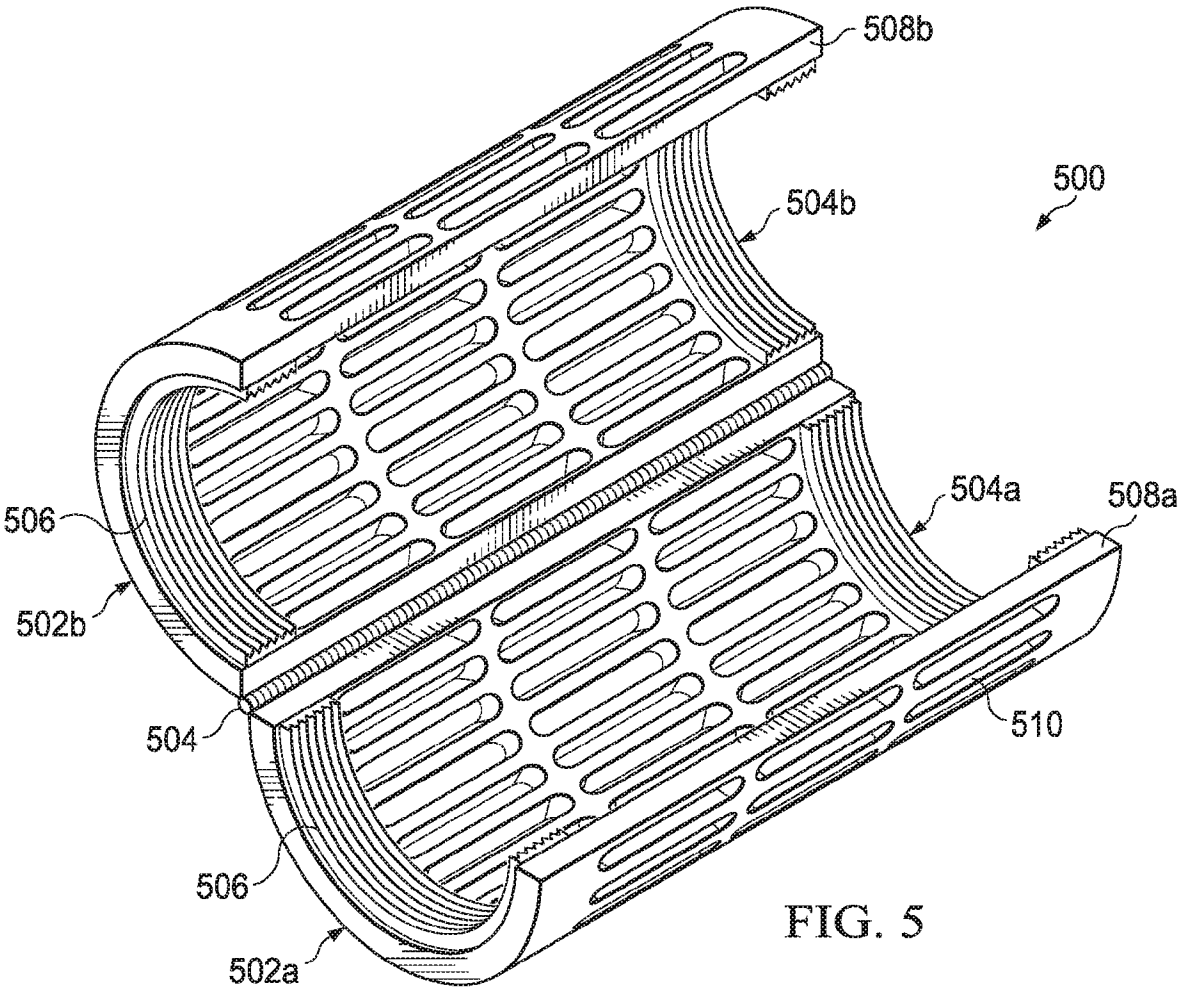
FIG. 5 illustrates a multiple component screened communication connector, in accordance with some embodiments of the present disclosure.

In other embodiments, a screened communication connector may be designed as two-components coupled with a hinge. FIG. 5 illustrates a multiple component screened communication connector, in accordance with some embodiments of the present disclosure. Screened communication connector 500 may be constructed of components 502*a* and 502*b* which may be coupled together by hinge 504. Hinge 504 may allow components 502*a* and 502*b* to be opened and closed. When components 502*a* and 502*b* are closed, components 502*a* and 502*b* may cause screened communication connector 500 to have a generally cylindrical shape. While screened communication connector 500 is shown as having two components 502*a* and 502*b*, it may have any number of components. Screened communication connector 500 may be sectioned along the length of screened communication connector 500 to form components 502*a* and 502*b*.

In some embodiments, screened communication connector 500 may be made of slotted liner 510. In other embodiments, screened communication connector 500 may be formed of a mesh screen. The mesh screen may be formed of wire-wrap screen, premium screen, or any other suitable screen material. Slotted liner 510 may be used when space in the wellbore is limited. A screened communication connector 500 formed of slotted liner 510 may be less expensive than a screened communication connector 500 formed of a mesh screen because slotted liner 510 may be easier to manufacture. The grain size of the mesh screen and/or slotted liner 510 on component 502*a* may be the same or different than the grain size of the mesh screen and/or slotted liner 510 on component 502*b*.

Screened communication connector 500 may move between a stowed position and an installed position by sliding between the stowed position and the installed position. However, it will be appreciated that screened communication connector 500 may be moved from a stowed position to an installed position through any suitable means and remain within the scope of the present disclosure. While in the stowed position, the components of screened communication connector 502*a* and 502*b* may be spaced apart from one another along edges 508*a* and 508*b*. After sliding into the installed position, the components of screened communication connector 502*a* and 502*b* may move about hinge 504 to close the space between edges 508*a* and 508*b*. Edges 508*a* and 508*b* may have designed such that, when closed, sand or other particulate material may not enter the interior volume of screened communication connector 500 along edges 508*a* and 508*b*. Screened communication connector 500 may be repositioned between a stowed position and an installed position as required by the subterranean operation.

In some embodiments, screened communication connector 500 may have threads 506 located on one or both ends of screened communication connector 500. Threads 506 may be designed to connect screened communication connector 500 with one or more screen joints. For example, threads 506 may serve as a seal member, such as seal member 312*a* or 312*b* shown in FIG. 3. In other embodiments, screened communication connector 500 may have one or more O-rings located at or near one or both ends 502*a*, 502*b*, 504*a*, and 404*b*. O-rings may be similar to O-ring 406 shown in FIG. 4. The O-rings may be designed to allow screened communication connector 500 to slide from a stowed position to an installed position where the O-rings may serve as a seal member. In a further embodiment, screened communication connector 500 may be designed such that after screened communication connector 500 is in the installed position, screened communication connector 500 forms an interference fit with one or more screen joints. In an interference fit embodiment, the friction between screened communication connector 500 and the screen joint fastens the two components together without the use of any mechanical fasteners. Threads 506, O-ring, or an interference fit may be designed such that the area between screened communication connector 500 and one or more screen joints is sealed such that sand or other particulate material may not pass through the seal member.

Embodiments disclosed herein include:

A. A screened communication connector that includes a hollow body including a plurality of holes to block particulate material from passing therethrough and allow fluid to pass therethrough, a first axial end of the hollow body, the first axial end including a first seal member for creating a particle tight seal between the first axial end and a first screen joint, and a second axial end of the hollow body, the second axial end including a second seal member for creating a particle tight seal between the second axial end and a second screen joint.

B. A screened communication connector that includes a first component including a first plurality of holes to block particulate material from passing therethrough and allow fluid to pass therethrough, a second component including a second plurality of holes to block fluids from passing therethrough and allow fluid to pass therethrough, a hinge coupling the first and second components together such that the first and second components are moveable between an open position and a closed position, the first and second components form at least a portion of a hollow body when in the closed position, a first axial end of the first component, the first axial end including a first seal member for creating a particle tight seal between the first axial end and a first screen joint, a second axial end of the first component, the second axial end including a second seal member for creating a particle tight seal between the second axial end and a second screen joint, a third axial end of the second component, the third axial end including a third seal member for creating a particle tight seal between the third axial end and a first screen joint, and a fourth axial end of the second component, the fourth axial end including a fourth seal member for creating a particle tight seal between the fourth axial end and a second screen joint.

C. A subterranean operations system that includes a base pipe, a plurality of screen joints, and a screened communication connector spanning at least two of the plurality of screen joints to prevent particles from entering the base pipe.

The screened communication connector includes a hollow body including a plurality of holes to block particulate material from passing therethrough and allow fluid to pass therethrough, a first axial end of the hollow body, the first axial end including a first seal member for creating a particle tight seal between the first axial end and a first screen joint, and a second axial end of the hollow body, the second axial end including a second seal member for creating a particle tight seal between the second axial end and a second screen joint.

D. A method of installing screened communication connector in a wellbore that includes positioning a screened communication connector on a first screen joint in a first position such that the screened communication connector overlaps the first screen joint, the screened communication connector including a hollow body including a plurality of holes to block particulate material from passing therethrough and allow fluid to pass therethrough, a first axial end of the hollow body, the first axial end including a first seal member for creating a particle tight seal between the first axial end and the first screen joint, and a second axial end of the hollow body, the second axial end including a second seal member for creating a particle tight seal between the second axial end and a second screen joint; installing the first screen joint, the second screen joint, and the screened communication connector in a wellbore; and sliding the screened communication connector from the first position to a second position such that the screened communication connector spans a space between and forms a particle tight seal between the first screen joint and the second screen joint.

Each of embodiments A, B, C, and D may have one or more of the following additional elements in any combination: Element 1: wherein the hollow body is formed of a mesh screen. Element 2: wherein the hollow body is formed of a slotted liner. Element 3: wherein the hollow body is formed of wire-wrap screen. Element 4: wherein the first or second seal member is a threaded connector. Element 5: wherein the first or second seal member is an O-ring. Element 6: wherein the hollow body has an interior diameter larger than an outer diameter of the screen joint. Element 7: wherein the hollow body is slidable from a stowed position over the screen joint to an installed position spanning the first and second screen joints. Element 8: wherein at least one of the first half or the second half of the hollow body further includes a plurality of sections, the plurality of sections are sectioned along a length of the first half or the second half. Element 9: wherein the hollow body further includes a first component, a second component, and a hinge coupling the first and second components together such that the first and second components are moveable between an open position and a closed position, the first and second components form at least a portion of the hollow body when in the closed position.

Although the present disclosure and its advantages have been described in detail, it should be understood that various changes, substitutions and alterations can be made herein without departing from the spirit and scope of the disclosure as defined by the following claims. For example, while the embodiment discussed describes a screened communication connector formed of a mesh screen or a slotted liner, the screened communication connector may be formed of any suitable material that may prevent sand or particulate material from entering a section of the production tubing while allowing fluids to pass through the material into the production tubing in a wellbore.

What is claimed is:

1. A downhole screened communication connector, comprising:

a hollow body including a plurality of holes to block particulate material from passing therethrough and allow fluid to pass therethrough, the hollow body longitudinally slidable from a stowed position over only a first screen joint to an installed position spanning the first screen joint and a second screen joint, the hollow body longitudinally slidable relative to both the first and second screen joint;

a first axial end of the hollow body, the first axial end including a first seal member for creating a particle tight seal between the first axial end and the first screen joint; and a second axial end of the hollow body, the second axial end including a second seal member for creating a particle tight seal between the second axial end and the second screen joint.

2. The screened communication connector of claim 1, wherein the hollow body is selected from the group consisting of a mesh screen, a slotted liner, a wire-wrap screen, and combinations thereof.

3. The screened communication connector of claim 1, wherein the first or second seal member is a threaded connector.

4. The screened communication connector of claim 1, wherein the first or second seal member is an O-ring.

5. The screened communication connector of claim 1, wherein the hollow body has an interior diameter larger than an outer diameter of the screen joint.

6. A downhole screened communication connector, comprising:

a first component including a first plurality of holes to block particulate material from passing therethrough and allow fluid to pass therethrough;

a second component including a second plurality of holes to block fluids from passing therethrough and allow fluid to pass therethrough;

a hinge coupling the first and second components together such that the first and second components are rotationally moveable between an open position and a closed position, the first and second components form at least a portion of a hollow body when in the closed position, when in the open position, the hollow body longitudinally slidable from a stowed position over only a first screen joint to an installed position spanning the first screen joint and a second screen joint, the hollow body longitudinally slidable relative to both the first and second screen joint;

a first axial end of the first component, the first axial end including a first seal member for creating a particle tight seal between the first axial end and the first screen joint;

a second axial end of the first component, the second axial end including a second seal member for creating a particle tight seal between the second axial end and the second screen joint;

a third axial end of the second component, the third axial end including a third seal member for creating a particle tight seal between the third axial end and the first screen joint; and a fourth axial end of the second component, the fourth axial end including a fourth seal member for creating a particle tight seal between the fourth axial end and the second screen joint.

7. The screened communication connector of claim 6, wherein the hollow body is selected from the group consisting of a mesh screen, a slotted liner, a wire-wrap screen, and combinations thereof.

8. The screened communication connector of claim 6, wherein at least one of the first, second, third, or fourth seal member is a threaded connector.

9. The screened communication connector of claim 6, wherein at least one of the first, second, third, or fourth seal member is an O-ring.

10. The screened communication connector of claim 6, wherein the hollow body has an interior diameter larger than an outer diameter of the screen joint.

11. The screened communication connector of claim 6, wherein at least one of the first half or the second half of the hollow body further includes a plurality of sections, the plurality of sections are sectioned along a length of the first half or the second half.

12. A subterranean operations system, comprising:

a base pipe;

a plurality of screen joints; and a screened communication connector spanning at least two of the plurality of screen joints to prevent particles from entering the base pipe, the screened communication connector longitudinally slidable from a stowed position over only one of the plurality of screen joints to an installed position spanning a first screen joint and a second screen joint, the screened communication connector longitudinally slidable relative to both the first and second screen joint, the screened communication connector including:

a hollow body including a plurality of holes to block particulate material from passing therethrough and allow fluid to pass therethrough;

a first axial end of the hollow body, the first axial end including a first seal member for creating a particle tight seal between the first axial end and the first screen joint; and a second axial end of the hollow body, the second axial end including a second seal member for creating a particle tight seal between the second axial end and the second screen joint.

13. The subterranean operations system of claim 12, wherein the hollow body is selected from the group consisting of a mesh screen, a slotted liner, a wire-wrap screen, and combinations thereof.

14. The subterranean operations system of claim 12, wherein the hollow body further comprises:

a first component;

a second component; and a hinge coupling the first and second components together such that the first and second components are moveable between an open position and a closed position, the first and second components form at least a portion of the hollow body when in the closed position.

15. A method of installing screened communication connector in a wellbore, comprising:

positioning a screened communication connector on a first screen joint in a first position such that the screened communication connector overlaps only the first screen joint, the screened communication connector including:

a hollow body including a plurality of holes to block particulate material from passing therethrough and allow fluid to pass therethrough;

a first axial end of the hollow body, the first axial end including a first seal member for creating a particle tight seal between the first axial end and the first screen joint; and a second axial end of the hollow body, the second axial end including a second seal member for creating a particle tight seal between the second axial end and a second screen joint;

installing the first screen joint, the second screen joint, and the screened communication connector in a wellbore; and longitudinally sliding the screened communication connector relative to the first and second screen joints from the first position to a second position such that the screened communication connector spans a space between and forms a particle tight seal between the first screen joint and the second screen joint.

16. The method of claim 15, wherein the hollow body is selected from the group consisting of a mesh screen, a slotted liner, a wire-wrap screen, and combinations thereof.

17. The method of claim 15, wherein the first or second seal member is a threaded connector.

18. The method of claim 15, wherein the first or second seal member is an O-ring.

19. The method of claim 15, wherein the hollow body has an interior diameter larger than an outer diameter of the screen joint.

20. The method of claim 15, wherein the hollow body further comprises:

a first component;

a second component; and a hinge coupling the first and second components together such that the first and second components are moveable between an open position and a closed position, the first and second components form at least a portion of the hollow body when in the closed position.

* * * * *